United States Patent [19]

Makary et al.

[11] 4,159,032

[45] Jun. 26, 1979

[54] CORE BOX

[75] Inventors: Vaughn W. Makary, Sharon, Pa.; Barry E. Miller, Youngstown; John N. Willis, Masury, both of Ohio

[73] Assignee: Midland-Ross Corporation, Cleveland, Ohio

[21] Appl. No.: 846,659

[22] Filed: Oct. 28, 1977

[51] Int. Cl.[2] ..... B22C 17/00

[52] U.S. Cl. ..... 164/403

[58] Field of Search ..... 164/170, 171, 173, 403, 164/227, 331, 185, 187, 224, 225, 409, 213, 214, 215, 226, 344, 345, 183, 184, 222, 223, 402, 404; 249/65, 68, 66 R, 67

[56] References Cited

U.S. PATENT DOCUMENTS

| | | | |
|---|---|---|---|
| 3,377,653 | 4/1968 | Buonaiuto | 249/68 X |
| 3,398,781 | 8/1968 | Bevis | 164/228 |
| 3,448,488 | 6/1969 | Kiraly | 249/68 X |
| 3,938,585 | 2/1976 | Rader | 164/347 |

*Primary Examiner*—Richard B. Lazarus
*Assistant Examiner*—John S. Brown
*Attorney, Agent, or Firm*—Harlan E. Hummer

[57] ABSTRACT

A core box having a core pattern and a self-contained mechanism for physically contacting a core, disposed within the pattern, and forcibly ejecting it from the pattern. The mechanism comprises a plurality of ejector pins which are movable into contact with the core by an inflatable bag disposed in the core box.

7 Claims, 2 Drawing Figures

CORE BOX

BACKGROUND OF THE INVENTION

The invention is particularly well suited for use in a process where the core is cured and hardened within the core box by $CO_2$ gas which is circulated into contact with the sand mixture of the core after the mixture is compacted in the pattern of the core.

Generally, cores used in the casting of parts in a foundry, are formed by compacting a sand mixture into the core pattern of a core box. The compacted, but untreated core, is then separated from the pattern by shaking the core box with vibrators. Nextly, the core is placed in an oven in which the sand mixture is cured and hardened. The heat treatment of the cores, formed in this manner, is expensive and time consuming.

It has been found that the use of $CO_2$ gas for hardening the cores within the core boxes, greatly speeds up this process. However, the foregoing method for stripping the cores from the core box does not work efficiently, and occasionally it becomes necessary to shutdown the process to remove, by hand, a hardened core that becomes stuck within the core box. The invention is directed to solving this particular problem.

Briefly stated, the invention is in a core box having a core pattern with a specially configured recess in which the core material is packed to form the core. The core box is provided with a self-contained mechanism for forcibly ejecting the core from the core box. This mechanism includes a plurality of ejector pins which are motivated into action by an inflatable bag, to physically engage the core and push it from the recess onto a rigid support or core board which is positioned for receiving the core. Thus, the cores are easily removed to provide a continuous $CO_2$ process for making cores used in a foundry.

DESCRIPTION OF THE DRAWING

The following description of the invention will be better understood by having reference to the annexed drawing, wherein.

DETAILED DESCRIPTION OF THE DRAWING

Figure 1:
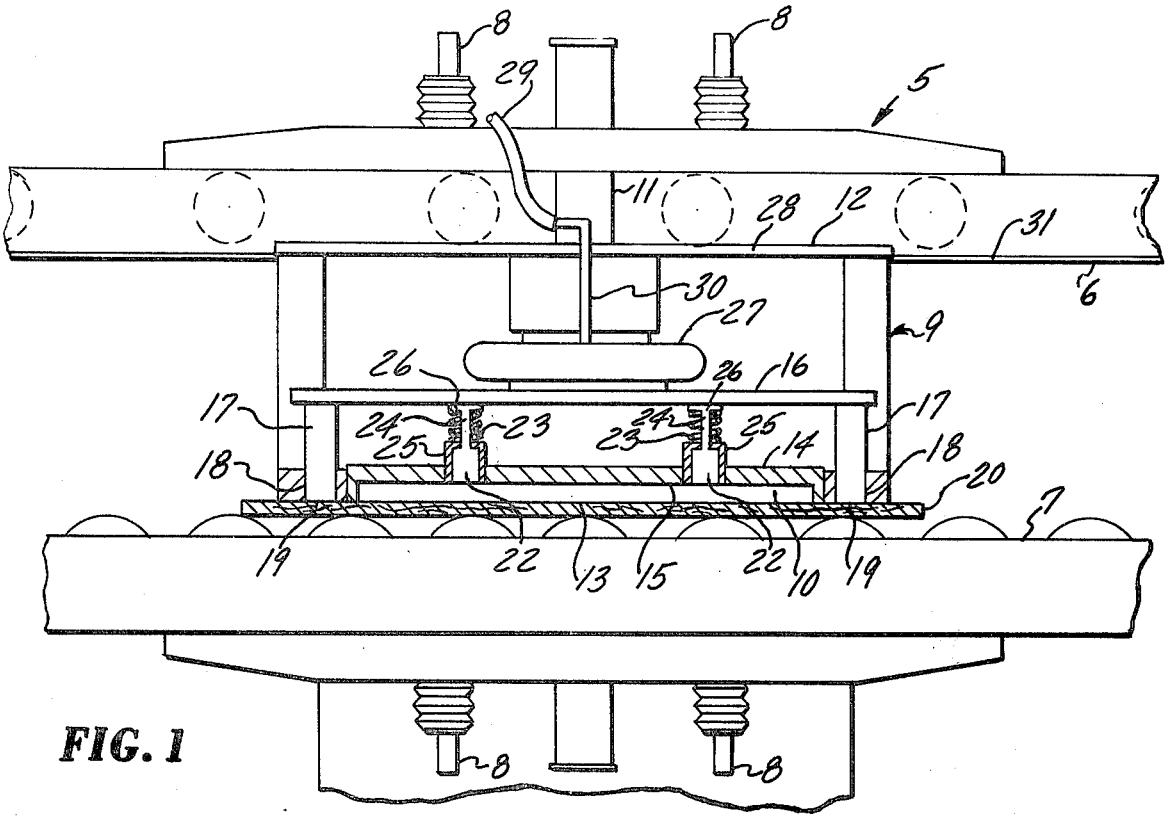
FIG. 1 is a side view of an automatic rollover core stripping machine which is shown in an inverted position in clamping relation with a core box that is made in accordance with the invention and shown in a rollover position for removal of the core from the core box, portions of the box being removed and shown in cross-section to better illustrate the invention.

With reference to the drawing, there is shown an automatic rollover core stripping machine 5, as manufactured by the Roperwerk Machine Company of Dusseldorf, Germany. The rollover machine 5 essentially comprises (1) a pair of parallel, roller-type conveyors 6,7, (2) a mechanism such as a plurality of similar air cylinders 8, for reciprocating the conveyors 6,7 into and out of clamping relation with a core box 9 which is initially rolled onto the vertically, lowermost conveyor 6 when the machine 5 is in a normally rest position, (3) a device (not shown) for rotating the conveyors 6,7 in a vertical plane, to rollover the core box 9 for stripping a core 10 therefrom, and (4) an apparatus such as a vibrator, for shaking the conveyors 6,7 and attached core box

9. The rollover machine 5 of the Roperwerk Machine Company, is provided with an adapter 11 through which $CO_2$ gas is circulated for contacting the core 10 to harden the core 10 so that it does not need further heat treatment. In this case, the adapter 11 has been converted to circulate air, under pressure, rather than $CO_2$ gas.

The core box 9 comprises a conventional housing 12 with an opening 13. A core pattern 14 is disposed in the opening 13 and provided with a configured recess 15 which faces outwardly of the core box 9. The recess 15 of the core pattern 14 is designed to receive any suitable sand mixture which is compacted within the recess 15 to form the finish core 10. $CO_2$ gas is then circulated to the sand mixture to harden the core 10 within the recess 15 of the core pattern 14.

A rigid pressure plate 16 is disposed within the core box 9 in spaced relation from the core pattern 14. A plurality of similar alignment rods 17 are secured to the pressure plate 16 in outstanding relation and are slidable within openings or guide holes 18 disposed in the core box 9 adjacent the core pattern 14. The free ends 19 of the alignment rods 17 contact a conventional rigid core board or support 20 which is manually positioned over the core box 9, when in a vertically upright, non-rolled over position, to receive the core 10 after it is forcibly ejected from the core pattern 14.

A plurality of similar ejector pins 22 are slidably mounted on the core pattern 14 for limited axial movement into and out of the recess 15 of the core pattern 14. A coil spring 23, surrounding the free end 24 of each of the ejector pins 22, is provided for biasing the ejector pins 22 out of contact with the core 10, or in a direction away from the recess 15 of the core pattern 14. The coil springs 23 are each held between a mounting 25 for the ejector pin 22 and a restraining washer 26 which is secured to the free end 24 of each of the ejector pins 22. The restraining washers 26, as best seen in FIG. 1, are in close proximity or abut from the pressure plate 16. The coil springs 23 serve a two-fold purpose; namely, they bias the ejector pins 22 out of contact with the core 10 and provide adjustable, rather than fixed length-type ejector pins 22 so that the ejector pins 22 will, preferably, simultaneously contact the core 10. The enlarged heads of the ejector pins 22 restrict axial movement of the pins 22 in a direction away from the recess 15, whereas the washers 26 restrict axial movement of the pins 22 in the direction of the recess 15 should the coil springs 24 break or fail for any reason.

An inflatable, elastic air bag 27 is coupled between the pressure plate 16 and rigid end closure 28 of the core box 9 opposite the opening 13 thereof. A suitable air cylinder could be used in place of the air bag 27. However, because of the limited space, it has been found more practical to use a small air bag 27 which, when inflated, causes movement of the pressure plate 16 into contact with the ejector pins 22, when the restraint of the conveyors 6,7 upon the core box 9 is partially or completely removed. A conventional air hose 29 is coupled to the adapter 11 of the rollover machine 5 for circulating air, under pressure, through an air passageway 30 which is in communication with the air bag 27.

Figure 2:
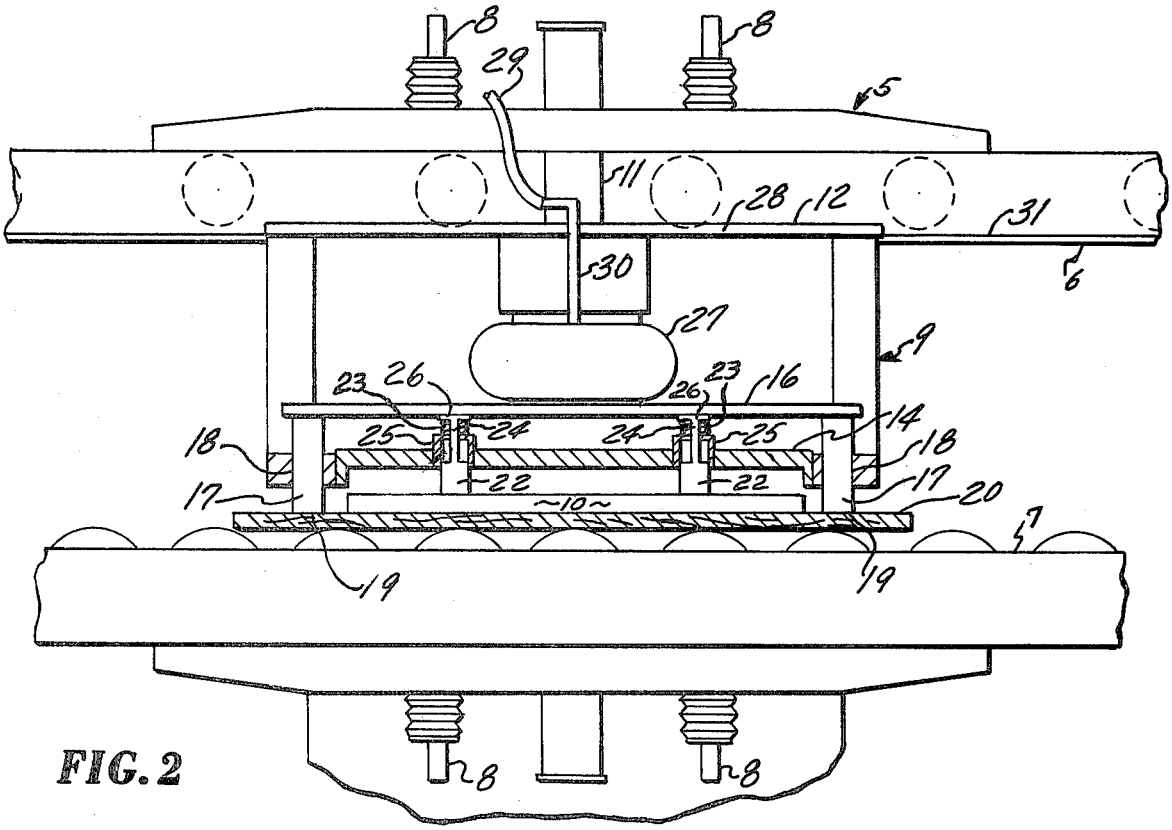
FIG. 2 is a similar view illustrating the core box after the core has been forcibly ejected therefrom.

In operation, the core box 9 is firstly held in a horizontal plane with the recess 15 of the core pattern 14 facing upwardly to receive a mixture of sand which is compacted into the recess 15 to form the core 10 which is then contacted with $CO_2$ gas to cure and harden the core 10 within the recess 15. The core box 9 with the core 10 facing upwardly is nextly moved onto the vertically lowermost conveyor 6 of the rollover machine 5. The rigid core board 20 is positioned atop the core box 9 and covers the core 10. The rollover machine 5 is then operated to move the conveyors 6,7 into clamping relation with the core box 9 and core board 20, after which the rollover machine 5 automatically rotates the core box 9 180° to an inverted position for removal of the core 10, as best seen in FIG. 2 where the recess 15 of the core pattern 14 faces downwardly and the core 10 rests on the core board 20. A limit switch, sensing rotation of the machine 5 and core box 9, activates a solenoid valve with an adjustable time delay, to cause inflation of the air bag 27. The machine 5 then acts to move the parallel conveyors 6,7 slowly apart. The lowermost conveyor 6 is provided with a channel 31 for engaging the rigid end closure 28 of the core box 9 to lift the core box 9 from the conveyor 7 against which the core board 20 rests. The air bag 27, being inflated with air, under pressure, expands upon movement of the conveyors 6,7 apart and acts against the pressure plate 16 to move it downwardly to initiate removal of the core 10 from the core box 9. The vibrators of the rollover machine 5 are simultaneously operated to shake the core box 9 to facilitate removal of the core 10. The alignment rods 17 push the core board 20 away from the core box 9 substantially simultaneously with the engagement of the pressure plate 16 with the ejector pins 22. The alignment rods 17 also maintain the pressure plate 16 parallel to the core pattern 14 as the plate moves to and from the recess 15. The expanding air bag 27 moves the pressure plate 16 against the ejector pins 22 and forces the pins 22 into the recess 15 to physically contact the core 10 and forcibly eject it from the core pattern 14 onto the core board 20. The core board 20 with the core 10 deposited thereon, is then removed from the rollover machine 5 after which the core box 9 is reclamped and rotated 180° back to its original position where the recess 15 of the core pattern 14 faces upwardly. The core box 9 is then unclamped and removed and recirculated for receiving a new mixture of sand in the core pattern 14.

Thus, there has been described a core box which has a self-contained mechanism for forcibly ejecting cores from the recess of the core pattern. Such a core box is especially useful in the $CO_2$ process where the core is hardened within the core box and is not readily removed by conventional shaking with vibrators.

We claim:

1. A core box comprising:

(a) a housing;

(b) a core pattern disposed in the housing and having a configured recess in which a core is formed;

(bb) a core board disposed adjacent the core pattern and having a planar surface covering the recess therein;

(bbb) means disposed interiorly of the housing for moving the core board from the recess; and (c) means disposed interiorly of the housing for physically contacting a core within the recess and forcibly ejecting it from the core pattern onto the core board as the core board moves from the recess, including:

(d) a plurality of ejector pins reciprocable into and out of the recess;

(e) means for mounting each of the ejector pins for axial movement in a direction which is angularly disposed to the plane of the recess; and (f) means for reciprocating the pins into and out of the recess, including:

(g) a plate position in spaced relation from the recess for engaging the ends of the pins farthest from the recess; and (h) means coupled to the plate and movable by fluid, under pressure, for moving the plate closer to the recess and forcing the ejector pins into the recess for contact with a core therein, including an inflatable elastic bag.

2. The core box of claim 1, wherein the means for moving the core board includes:

(i) a plurality of rods secured to the plate and slidably mounted on the core pattern in parallel relation, the rods being sized to contact the core board prior to the contact of the pins with a core in the recess.

3. The core box of claim 2, wherein the pin reciprocating means (f) includes:

(j) means coating with the core pattern for biasing the ejector pins in a direction away from the recess.

4. The core box of claim 3, wherein the pin reciprocating means (f) includes means coacting with the core pattern for limiting axial movement of the ejector pins in a direction away from the recess.

5. The core box of claim 4, which includes:

(k) a pair of parallel conveyors;

(l) means for clamping the core box between the pair of parallel conveyors in a first position where the recess is in a horizontal plane facing upwards;

(m) means coacting with the conveyors for moving the conveyors further apart when the core box is in a second position where the recess is in a horizontal plane facing downwards; and (n) means coacting with the bag for inflating the bag, prior to movement of the conveyors further apart, to cause movement of the core board from the housing and subsequent ejection of the core from the core box as the conveyors move further apart.

6. A core box, comprising:

(a) a box-like housing having an opening in one end thereof;

(b) a core pattern disposed in the opening and having a recess facing outwardly of the box for receiving material for forming a core in the recess;

(c) a rigid plate disposed within the housing in spaced relation from the core pattern;

(d) a plurality of ejector pins disposed between the core pattern and plate and movable by the plate into physical contact with a core formed in the recess to forcibly eject the core from the core pattern;

(e) means coacting with the ejector pins for biasing them in a direction away from the recess and core formed therein;

(f) an inflatable air bag coupled between the housing and plate in opposed relation to the ejector pins, the air bag being inflatable with gas, under pressure, to cause movement of the plate and corresponding movement of the ejector pins;

(g) means coacting with the ejector pins for mounting the ejector pins on the core pattern for limited axial movement into and out of the recess;

(h) means coacting with the plate for maintaining the plate parallel to the plane of the recess as the plate moves to and from the recess, said means also designed to move a core board on which the core is deposited after ejection from the core pattern, away from the core pattern and housing substantially simultaneously with contact of the plate with the ejector pins.

7. The core box of claim 6, including:

(i) a pair of parallel conveyors between which the core box is positionable;

(j) means coacting with the pair of parallel conveyors for clamping the core box between the conveyors in a first position where the recess is in a horizontal plane facing upwards;

(k) a rigid core board insertable between the recess and closest conveyor;

(l) means coacting with the conveyors for moving the conveyors further apart when the core box is in a second position where the recess is in a horizontal plane facing downwards; and (m) means coacting with the bag for inflating the bag, prior to movement of the conveyors further apart, to cause movement of the core board from the housing and subsequent ejection of the core from the core box as the conveyors move further apart.

* * * * *